US011615671B1

(12) United States Patent
Shoemaker, Jr.

(10) Patent No.: US 11,615,671 B1
(45) Date of Patent: Mar. 28, 2023

(54) CLAW FOR ARCADE GAME

(71) Applicant: Stephen P. Shoemaker Trust, Manhattan Beach, CA (US)

(72) Inventor: Stephen P. Shoemaker, Jr., Redondo Beach, CA (US)

(73) Assignee: Stephen P. ShoemakerTrust, Manhattan Beach, CA (US)

( * ) Notice: Subject to any disclaimer, the term of this patent is extended or adjusted under 35 U.S.C. 154(b) by 0 days.

(21) Appl. No.: 17/943,112

(22) Filed: Sep. 12, 2022

(51) Int. Cl.
*G07F 17/32* (2006.01)
*A63F 9/30* (2006.01)

(52) U.S. Cl.
CPC ..... *G07F 17/3216* (2013.01); *A63F 9/30* (2013.01); *G07F 17/3297* (2013.01)

(58) Field of Classification Search
CPC ... G07F 17/3297; A63F 9/30; B25J 15/00–12; B65G 47/90
USPC ..... 294/104
See application file for complete search history.

(56) References Cited

U.S. PATENT DOCUMENTS 3,013,835 A * 12/1961 Blatt ..... B25J 15/0206 414/753.1
4,718,667 A * 1/1988 Shoemaker, Jr. ..... A63F 9/30 212/320
7,793,938 B2 * 9/2010 Watanabe ..... G07F 17/3295 273/447

* cited by examiner

*Primary Examiner* — Laura Davison
(74) *Attorney, Agent, or Firm* — Fulwider Patton LLP

(57) ABSTRACT

A claw mechanism for an amusement game such as an arcade crane game is disclosed with a movable leg or prong that pivots about a pin to capture a target at the target's upper rim. The prong is actuated by a solenoid that retracts a rod, causing the prong to pivot inward toward a pair of stationary prongs or fixed support such as a half tube. The prong may be formed with a notch that is configured to engage the rim of an aluminum can for lifting the target/prize off a turntable and into a retrieval bin.

6 Claims, 4 Drawing Sheets

CLAW FOR ARCADE GAME

BACKGROUND

Arcade games using a mechanical claw to remove prizes from a dedicated prize area have been around for decades. Earlier versions of the game required that the prizes be easily grasped with a claw type pick-up device, such as plush toys. However, the type of prizes that can be secured with various pick-up devices has increased in recent years, and the present invention is directed to games that use beverages such as cans and bottles for prizes (but can also be used with tubular prizes such as LIFESAVER® candies), and they are very popular with game players.

Most canned beverages have a pull tab on an upper surface and a narrowed, neck portion just below the upper surface. The smooth surface and absence of any real structure to grasp onto has made canned beverages a difficult prize to use with arcade games using a mechanical claw. The present invention addresses this shortcoming of the prior art.

SUMMARY OF THE INVENTION

The present invention is an arcade game that uses canned or bottled beverages as the prize, and employs a mechanical three pronged claw to capture the prize. Each prong of the claw may be formed with a barb at the end including a recess that is shaped to latch onto the upper rim of the beverage prize. In one preferred embodiment, one prong is actuated by a motor to move radially in and out, such that the claw can clear the upper surface of the can or bottle on the way down, and then engage the neck and upper rim of the prize before lifting it away from the playing field. By actively "grabbing" the prize against two stationary prongs or a curved backdrop, the game is more reliable and gives players a better sense of fairness to the game, encouraging playing and increased profits for the game's owner.

These and other features of the invention will best be understood with reference to the figures along with the detailed description of the invention presented below.

DETAILED DESCRIPTION OF THE PREFERRED EMBODIMENTS

The present invention is an improved mechanical claw for use in arcade games that is specially designed to capture the upper rim or circumferential edge of an aluminum can or plastic cap found on certain energy drinks, or for other tubular prizes. The claw can be made specific to a selected diameter of the target, such as for example an 8.4 ounce can popular with energy drinks. Prior art claws are incapable of picking up targets such as cans when the cans are displayed right side up, so prior games had to arrange the prizes upside down and use a magnet or some other modification to capture the prize. In the present invention, the claw is configured so that two prongs are fixed and do not move, while a third prong is motor actuated to move radially inward. Smaller diameter prizes can be captured by adjusting a screw to make capture easier or more difficult. This allows the three prongs to capture the can or bottle at the neck while preventing the can from slipping. The player must maneuver the claw so that the inwardly facing recess or slot on the prongs align with the upper rim of the target, which then allows the claw to grasp the upper rim and capture the prize.

In a preferred embodiment, the claw includes a feature whereby the distance of the prongs relative to a centerline of the target is increased or decreased, which in turn varies the difficulty of the game. Game owners like to be able to control the win percentage, and varying the skill required to win is helpful to this end.

Figure 1:
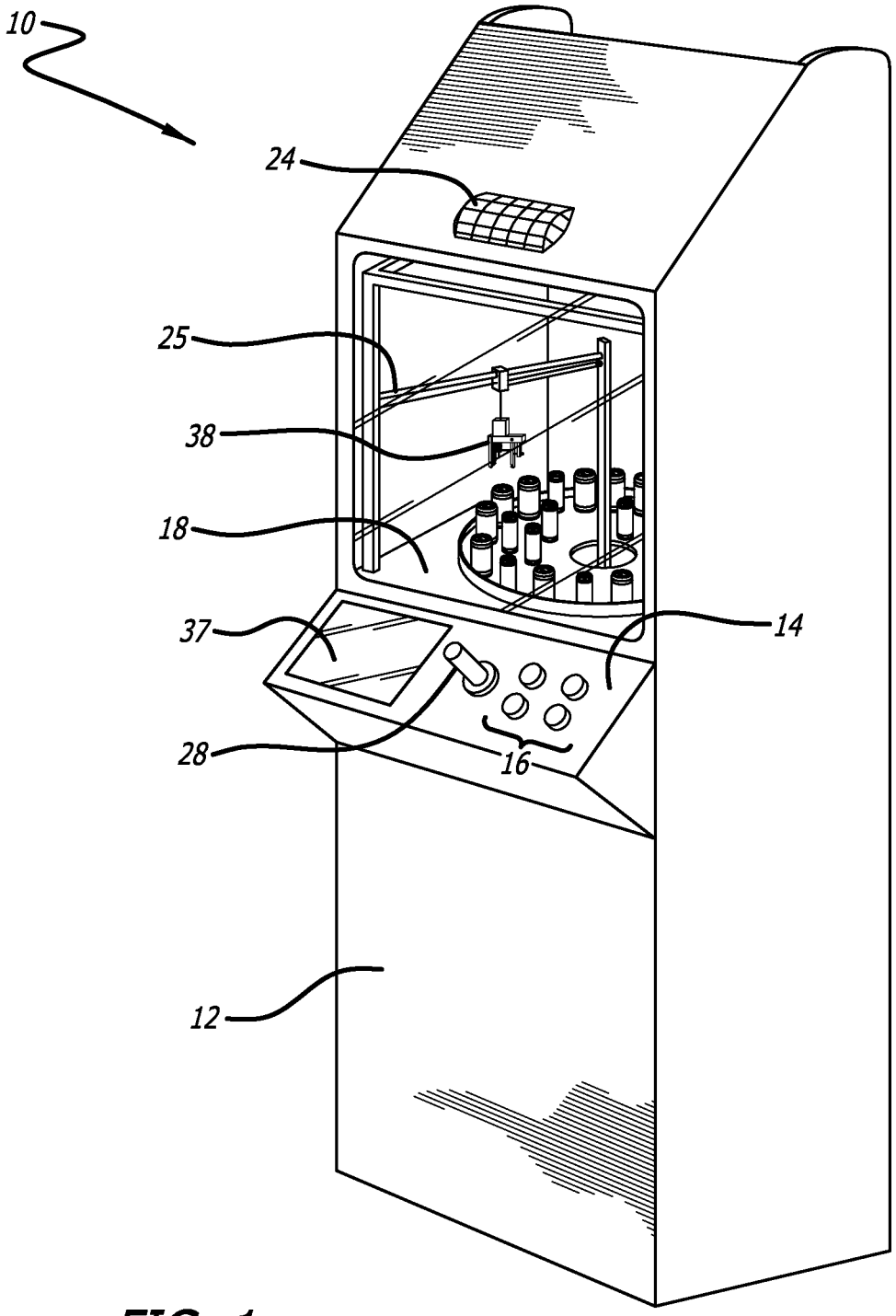
FIG. 1 is an elevated, perspective view of an example of an arcade game of the type embodying the present invention.

FIG. 1 illustrates an arcade game of the type that uses the present invention, in the form of a stand up cabinet housing the various components and elements of the game. The elements of the game can be found in the inventor's previous patents, including U.S. Pat. Nos. 10,792,559, 10,902,704, 11,313,443, 11,164,428, and 11,011,029, the contents of which are fully incorporated herein by reference. Some details of the operation of the game are omitted herein for brevity but can be found in the referenced patents, all invented by and assigned to the present inventor.

The arcade game 10 is housed in cabinet 12 that encloses the other components of the game apparatus. Housings can take a wide variety of forms; for example, as shown in FIG. 1, cabinet 12 may be of the stand-up arcade game variety in which a player stands in front of the game or sits on a stool when playing the game. In other embodiments, other types of housings may be provided. For example, a counter-top housing, including approximately the upper half of cabinet 12 shown in FIG. 1, can be used when the game apparatus is desired to be placed on a table, counter top or other similar surface.

Front panel 14 can be positioned below and/or above the player controls 16 and playing field 18, as shown in FIG. 1. The targets are preferably a type of beverage that is packaged in ubiquitous aluminum cans, small bottles, candy tubes, etc. arranged on a stationary platform or rotating playing field. A pick-up device is used to both capture the targets in the playing field and to deliver any successfully captured prizes from playing field 18 to a player-accessible retrieval bin 20 where the player retrieves the prize. Speaker(s) 24 emits sounds based on game actions and other game states and is controlled by a game control system.

Player controls 16 allow a player to manipulate events in the game, and typically include a joystick, buttons, switch, knob, or the like. Game action occurs in playing field 18, where a pick up mechanism may be controlled and guided by the player to pick up prize objects, as described below. In the embodiment of FIG. 1, a joystick 28 or similar device (knob, two buttons, etc.) can be manipulated by the player to move the pick-up device in a linear direction (forward and backwards) along a fixed support beam 25. Buttons can also be provided to select various game functions, such as additional velocity control of the pick-up device, number of players in a game, a start button to begin the game, etc. For example, in the described embodiment, a stop or slow button can be pressed by the player to slow down (or stop) the rotational movement of a prize turntable so as to allow the player to more accurately position the pick-up device. In alternate embodiments, the player may be able to control motion of other components of the game, such as horizontal or downward movement of the pick-up device. In some embodiments, a player may get multiple chances to guide the pick-up mechanism with one coin or credit, or, alternatively, the player may be required to insert additional coins.

Game playing field 18 is used to display the game action and prizes to a player and is the area where game action occurs. A transparent shield prevents the player from interfering with game action. The playing field 18 includes a turntable-like support 50 that rotates so that every prize falls below or is otherwise accessible to the pick-up device at some point. In some embodiments the player guides the pick-up device 38 horizontally over the playing field, and then either the player or the automatic control of the game lowers the pick-up device 38 over a selected prize in an attempt to capture the prize. If a prize is picked up, the game controller automatically guides the pick-up device 38 with the prize attached to the retrieval bin window 37, which leads to the player's retrieval bin.

Figure 2:
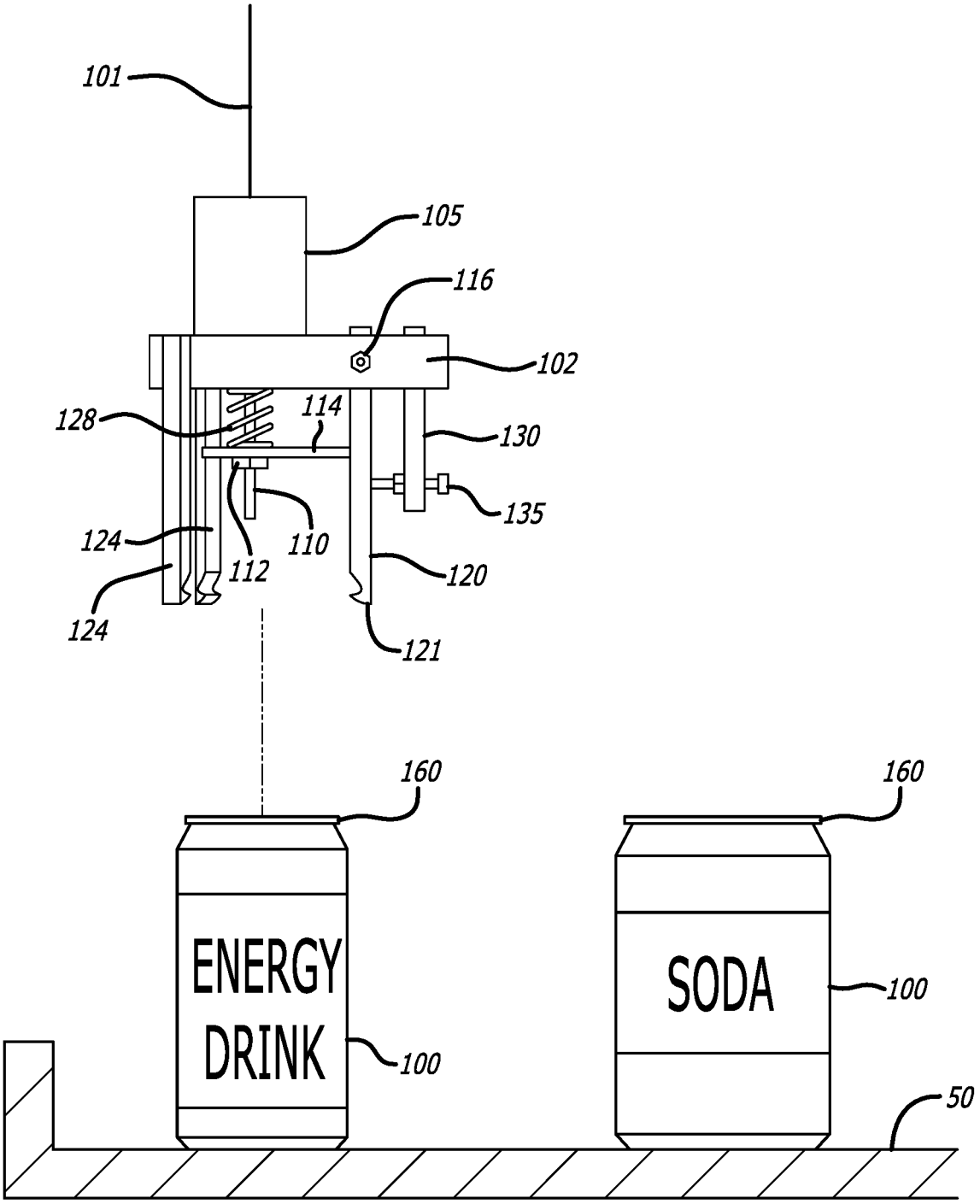
FIG. 2 is an enlarged, side view of the modified mechanical claw and prize prior to acquisition.
Figure 3:
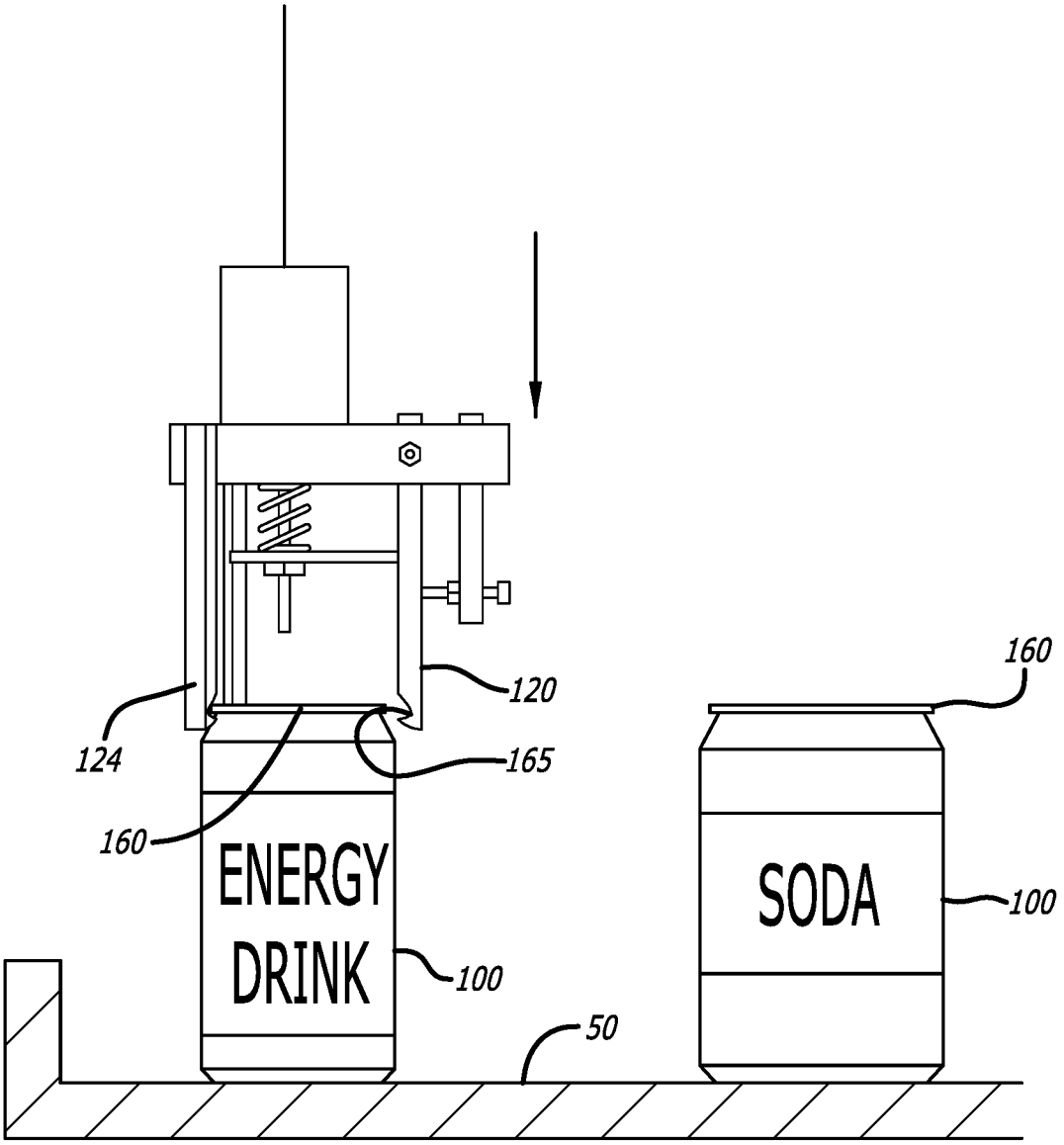
FIG. 3 is an enlarged, side view of the modified mechanical claw and prize when the claw makes contact with the prize.
Figure 4:
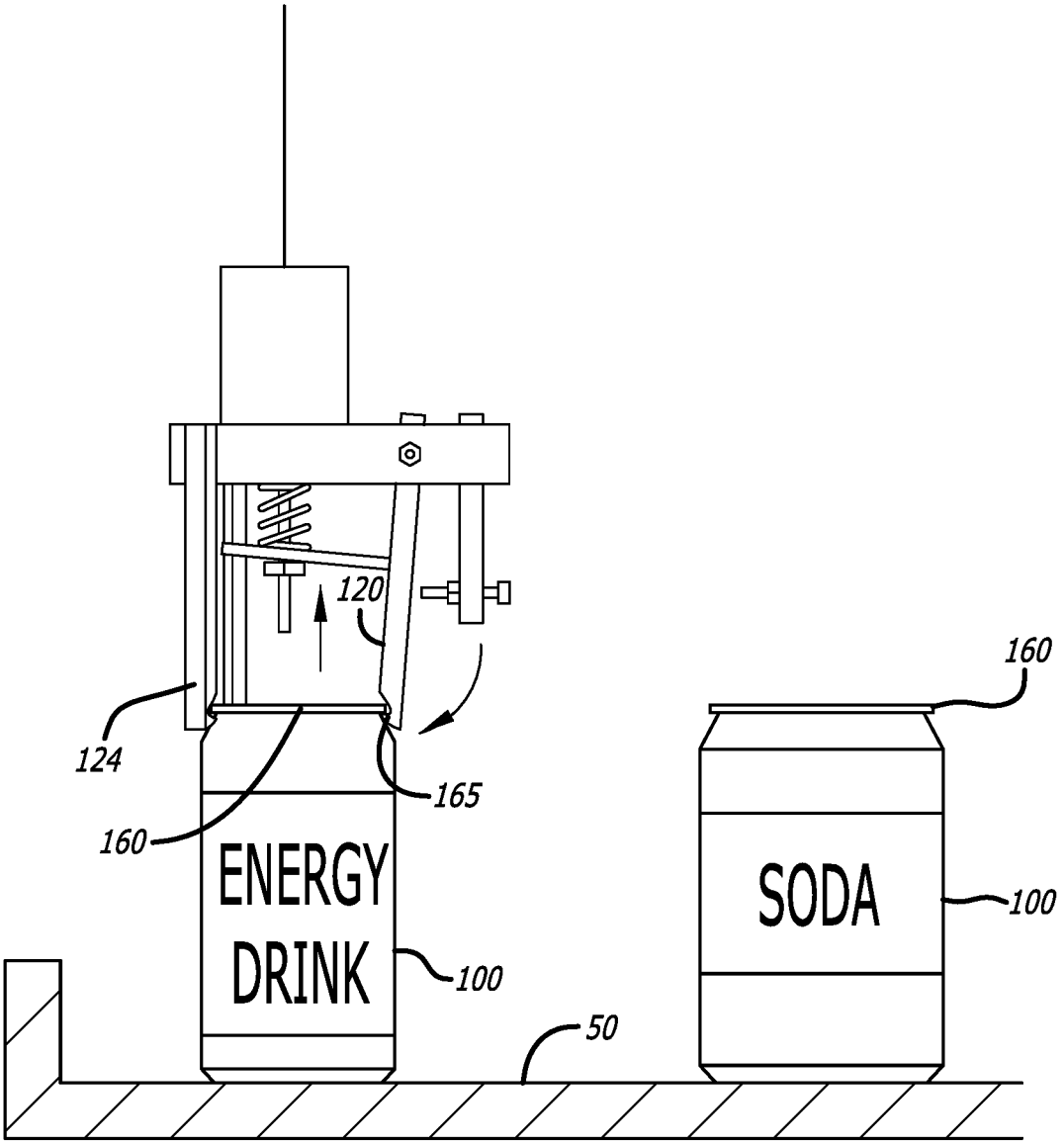
FIG. 4 is an enlarged, side view of the modified mechanical claw engaging the prize with the solenoid-activated prong.

FIGS. 2-4 illustrate a new pick up device particularly suited for cylindrical targets such as canned beverages, energy drinks, batteries, tube candy packages, and the like. The targets 100 are arranged on the support 50 below the pick-up device 38, which in this case is a mechanical claw capable of clamping onto the targets 100. When the pick-up device is lowered onto the target 100, a pivoting prong rotates into engagement with an upper lip of the target if the pick-up device is properly positioned by the player. Screws may be added to incorporate player adjustment to the game but the advantage cannot be changed during play. Once the target 100 is acquired by the solenoid actuated mechanical claw, it is lifted off the support 50 and moved to a retrieval bin where it can be collected by the player.

The mechanical claw pick-up device is suspended by a cable 101 and includes a platform 102 in the form of a frame. Mounted to the frame is a twelve volt solenoid 105 configured to withdraw a rod 110. The rod 110 is extended in the unbiased condition and retracted when the solenoid 105 is actuated. On the distal end of the rod 110 is a threaded portion onto which a nut 112 is placed. The nut 112 bears against a rigid plank 114 with a forked end through which the rod 110 passes. The opening in the fork is wide enough to pass the threaded portion of the rod but not the nut 112, so when the rod is retracted, the nut pushes up the rigid plank 114 and pivots the plank 114 about pin 116. The plank 114 is connected to a prong 120 of the mechanical claw, such that the end 121 of the prong 120 rotates toward the other two prongs 124 when the plank 114 is raised by the rod 110. A coil spring 128 is disposed between the solenoid 105 and the plank 114 to push the plank away from the solenoid, which in turn rotates the pivoting prong 120 away from the other two prongs 124. The distance between the pivoting prong 120 and the other two prongs 124 (or other rigid support) determines the clearance for the player to capture a target 100. A stop 130 is mounted to the platform 102 behind the prong 120 to establish the maximum outward deflection of the moving prong 120 when the spring is fully extended. Here, the stop 130 is adjustable using a threaded fastener 135 so as to make the width between the prong 120 and the other two prongs 124. By setting this distance judiciously, the game proprietor can vary the difficulty of the game by managing the clearance between the prongs and the diameter of the prizes. In some embodiments, the two fixed prongs 124 can be replaced with a curved plate or other backstop to prevent the prize from moving or tilting backwards in response to the movement of the movable prong 120.

The solenoid is energized by a twelve VDC voltage that is converted from a signal sent along the cable 101 by the game's processor. When the movable prong is rotated or pivoted against the target 100, the notched or barbed end of the prongs 120, 124 engage and capture the lip 160 of the target 100 and allow the target to be raised by the pick-up device. The notching at the bottom of the prongs permits the lip or rim of the target to rest its physical weight upon the notching and therefore relies significantly less on the closure grip strength of the pick-up device. This allows significantly heavier prizes to be captured when compared with claws of traditional design. With tubular candy packages, the prizes are very light weight and a notch is unnecessary to capture and lift the target.

FIG. 3 illustrates the positioning of the pick-up device 38 at the target's upper surface. The distance between the moving prong 120 and the fixed prongs 124 establish the margin for which the player has to position the claw over the target 100. If the pick-up device is not positioned so as to allow the target to fit between the prong 120 and the prongs 124, the target cannot be acquired and the attempt will fail. If the player is successful in positioning the ends of the prongs as shown in FIG. 3, the mechanism is in position to acquire the target 100. An electronic signal is sent along the cable 101 to the solenoid 105, which in turn retracts the rod 110. The movement of the rod 110 and the nut 112 lifts the plank 114, causing the plank and the prong 120 to pivot inward about pin 116 (see FIG. 4). Rotation of the prong 120 causes the lip of the target to be engaged by the barb or notch 165 of the prong 120, securing the target to the pick-up device. The pick-up device is now raised and carried to the retrieval bin where it can be collected by the player. The electronic signal, sent along cable 101 to the solenoid 105, is discontinued which in turn de-energizes the solenoid causing the rod 110 to release the prize.

Example 1

The timing of a twenty one inch diameter turn table is of a constant speed from play to play, and it was clocked at one revelation in 20 seconds. Based on a 19 inch diameter, a position of outer perimeter target cans, the circumference is about 60 inches of travel (59.69 inches) movement in 20 seconds, or one foot in 4 seconds. To be successful a player must stop the turntable with a target can underneath the forward and reverse tracking line position of an overhead claw mechanism. The claw is about twelve inches above the turntable platform and about 6 inches about the target. The player's task is to align the claw within the circular base target of an upright aluminum can with a diameter of about two to three inches. One push of the player control button instantaneously stops all movement of the claw. A slight pause and the claw will lower, lifts and retrieve the can to a retrieval bin for delivery to the player. Missing the target area of the cylindrical target will cause the claw to return without a prize.

While the foregoing described the inventor's preferred embodiments, it is understood that other variations are possible and would be apparent to one of ordinary skill in the art. The scope of the invention is intended to include all such variations. Unless specifically stated herein, no depiction or description of the preferred embodiments should be considered limiting or exclusive. Rather, the scope of the invention is properly determined by the words of the appended claims using their customary and ordinary meanings.

I claim:

1. A claw mechanism for an arcade game, comprising:

a platform;

a solenoid mounted on the platform, the solenoid including a vertically oriented rod that is actuated by the solenoid to elevate in response to an electrical signal;

a rigid support extending downwardly from the platform;

a pivoting prong pinned at the platform by a pin and configured for rotation about said pin in response to vertical movement of the vertically oriented rod, the pivoting prong including a notch at a lower end thereof;

a biasing member pushing said pivoting prong outwardly in the absence of a contravening force by the solenoid; and a stop mounted on the platform for determining a maximum separation between said pivoting prong and the rigid support.

2. The claw mechanism of claim 1, wherein the rigid support comprises first and second rigid prongs opposed said pivoting prong.

3. The claw mechanism of claim 1, wherein the stop is adjustable to vary the maximum separation.

4. The claw mechanism of claim 1, wherein the biasing member is a spring.

5. The claw mechanism of claim 1, wherein the claw mechanism is attached to an electrical cable.

6. The claw mechanism of claim 1, wherein movement of the pivoting prong is conveyed through a rigid plank in contact with the vertically oriented rod.

* * * * *